US006388633B1

(12) United States Patent
Imaizumi et al.

(10) Patent No.: US 6,388,633 B1
(45) **Date of Patent: *May 14, 2002**

(54) MULTIBEAM ANTENNA

(75) Inventors: Hiroaki Imaizumi; Koji Sakauchi; Shuji Hagiwara; Hirofumi Higuchi; Ryotaro Manabe, all of Saitama (JP)

(73) Assignee: Yagi Antenna Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/498,752

(22) Filed: Feb. 7, 2000

Related U.S. Application Data

(63) Continuation of application No. 08/961,767, filed on Oct. 31, 1997.

(30) Foreign Application Priority Data

Nov. 15, 1996 (JP) ..... 8-304791
Dec. 3, 1996 (JP) ..... 8-322974
Dec. 9, 1996 (JP) ..... 8-328295

(51) Int. Cl.[7] ..... H01Q 13/02
(52) U.S. Cl. ..... 343/776; 343/786; 343/783; 343/895
(58) Field of Search ..... 343/783, 786, 343/776, 753, 895; H01Q 13/02

(56) References Cited

U.S. PATENT DOCUMENTS 3,216,017 A 11/1965 Moore ..... 343/756
3,553,707 A * 1/1971 Yang et al. ..... 343/786
3,803,617 A * 4/1974 Fletcher et al. ..... 343/786
4,400,703 A * 8/1983 Shiokawa et al. ..... 343/895
4,574,289 A 3/1986 Henderson ..... 343/786
4,658,258 A 4/1987 Wilson
4,806,945 A 2/1989 Cormier et al. ..... 343/756
5,005,023 A * 4/1991 Harris ..... 343/786
5,043,683 A 8/1991 Howard ..... 333/21 A (List continued on next page.)

FOREIGN PATENT DOCUMENTS

| | | | |
|---|---|---|---|
| FR | 2 745 661 | 9/1997 | ..... H01Q/23/00 |
| GB | 2 222 486 A | 3/1990 | |
| JP | 60-196003 | 4/1985 | |
| JP | 60-132406 | 7/1985 | |
| JP | 63-114402 A | 5/1988 | |
| JP | 3-141707 | 6/1991 | |
| JP | 4-117705 | 4/1992 | |
| JP | 4-329722 | 11/1992 | |
| JP | 5-243814 | 9/1993 | |
| JP | 6-61733 | 3/1994 | |
| WO | WO 95/06963 | 3/1995 | ..... H01Q/19/17 |
| WO | WO 96/02953 | 2/1996 | ..... H01Q/3/12 |

*Primary Examiner*—Michael C. Wimer
(74) *Attorney, Agent, or Firm*—Sughrue Mion, PLLC

(57) ABSTRACT

When a converter 14 is rotated via a rotation mechanism 17, the arrangement inclination angle of two primary radiators 15*a* and 16*b* can be adjusted in the range of 0 to 20 deg. with respect to an axis which is in parallel with the ground. Also the reception polarization angle due to probes of the primary radiators 15*a* and 15*b* can be adjusted in the range of 0 to 20 deg. while maintaining a preset difference in polarization angle among the satellites. Therefore, the arrangement inclination angle of the primary radiators 15*a* and 16*b* for respectively receiving signals from the two satellites, and the reception polarization angle in the primary radiators 15*a* and 15*b* can be simultaneously easily adjusted by rotating the converter 14 via the rotation mechanism 17.

14 Claims, 15 Drawing Sheets

U.S. PATENT DOCUMENTS 5,166,698 A * 11/1992 Ashbaugh et al. ..... 343/786
5,229,736 A 7/1993 Adams et al. ..... 333/21 A
5,426,442 A 6/1995 Haas ..... 343/778
5,434,586 A 7/1995 Kinoshita
5,440,279 A 8/1995 Kinoshita
5,444,455 A 8/1995 Louzir et al. ..... 343/895
5,463,358 A 10/1995 Dunn et al. ..... 333/1
5,696,519 A 12/1997 Suzuki et al. ..... 343/761
5,812,096 A * 9/1998 Tilford ..... 343/776
5,825,333 A 10/1998 Kudoh

* cited by examiner

MULTIBEAM ANTENNA

This is a continuation of application No. 08/961,767 filed Oct. 31, 1997, the disclosure of which is incorporated herein by reference, now U.S. Pat. No. 6,121,939.

BACKGROUND OF THE INVENTION

The invention relates to a multibeam antenna which is used for receiving micro waves from plural geostationary satellites.

Recently, many geostationary broadcasting satellites and geostationary communication satellites have been launched. The need for receiving micro waves from, for example, two adjacent satellites by using a single antenna and selectively using one of the received micro waves is increasing.

Conventionally, a multibeam antenna which receives micro waves from plural satellites is configured so that micro waves from plural satellites are reflected and focused by a single parabola reflector and the focused satellite signals respectively enter different primary radiators.

Horn type primary radiators (or feedhorns) are used as the primary radiators. When two satellite micro waves are to be received, for example, two horn type primary radiators are supported by an arm so as to be placed at the reflection and focusnce position of the parabola reflector. The elevation angles for the satellites with respect to the ground are different from each other. Furthermore, the degree of the difference in elevation angle is varied depending on the receiving areas. For each receiving area, therefore, the inclination of the horn arrangement of the primary radiators with respect to an axis which is in parallel with the ground must be adjusted.

Hereinafter, the inclination of the horn arrangement of primary radiators with respect to an axis which is in parallel with the ground is referred to as the inclination angle.

In the case where satellite signals to be received are linearly polarized, the inclination of each incident micro wave with respect to the ground is changed depending on the satellites and receiving areas. For each receiving area, therefore, the reception polarization angle of each primary radiator must be adjusted.

When the direction of the conventional multibeam antenna for linearly polarized waves is to be adjusted, therefore, the arrangement inclination angles of primary-radiator horns with respect to each satellite, and the reception polarization angles of primary radiators must be adjusted in accordance with the receiving area. This produces problems in that a mechanism for adjusting the angles is complicated in structure, and that the adjusting work is cumbersome.

Conventionally, a flaring horn type primary radiator is usually used as a primary radiator of an antenna for satellite broadcasting. Even when a parabola reflector has a small diameter of, for example, 45 cm ϕ, the arrangement distance among the primary radiators can be sufficiently made large as far as adjacent satellites from which micro waves are to be received are separated from each other by an elongation of about 8 deg. Consequently, flaring horns of primary radiators can be adjacently arranged without interfering with each other. By contrast, in the case where adjacent satellites from which micro waves are to be received are separated from each other by a small elongation of 4 deg., the arrangement distance among the primary radiators is as small as about 25 mm. As a result, when such flaring horn type primary radiators are used, the radiator horns interfere or contact with each other and hence it is impossible to constitute a multibeam antenna, thereby producing a problem in that plural antennas respectively for satellites from which micro waves are to be received must be installed.

As discussed above, in a primary radiator of a 45-cm ϕ dual-beam antenna system which receives micro waves of the 12 GHz band from two satellites of an elongation of 4 deg., for example, the horn interval is about 25 mm. When a primary radiator of such an antenna is configured by a usual flare horn as shown in FIGS. 22(A) and 22(B), the aperture diameter is about 30 mm. Therefore, the antenna cannot be structurally configured. In order to realize such an antenna system, it is required to set the aperture diameter of a primary radiator to be 25 mm or less. In a circular waveguide designated as WCI-120 in EIAJ (Standard of Electronic Industries Association of Japan), the inner diameter of the waveguide is 17.475 mm. When such a waveguide is used, therefore, the horn has substantially a flare angle of about 0 deg. in consideration of the production process of an actual product. In other words, the horn has a circular waveguide section aperture as shown in FIGS. 23(A) and 23(B).

FIG. 22(A) is a front view of the conventional flare horn type primary radiator, and FIG. 22(B) is a section view taken along the line A–A' of FIG. 22(A). FIG. 23(A) is a front view of a conventional circular waveguide type primary radiator, and FIG. 23(B) is a section view taken along the line A–A' of FIG. 23(A).

In FIG. 22(A) and 22(B), 131 designates a flared waveguide which is disposed on a substrate 132. A feeding point 133 is configured by a printed circuit formed on the substrate 132, so as to be positioned at the center of the bottom face of the flared waveguide 131.

The circular waveguide type primary radiator shown in FIGS. 23(A) and 23(B) is a circular waveguide 135 in place of the flared waveguide 131. The other components are configured in the same manner as those of the flare horn type primary radiator of FIG. 22(A).

FIG. 24 shows the radiational pattern of the circular waveguide type primary radiator. In the case where the reflector is offset, the radiation angle of the primary radiator is about 40 deg. In the directional pattern of FIG. 24, the leakage power is large in the reflector irradiation, and the unevenness of the electric field in the reflector irradiation range is large. Therefore, the antenna gain is lowered.

Methods such as that in which the horn aperture diameter is reduced, that in which a helical antenna is used with supplying a power through a coaxial system, and that in which a traveling-wave type antenna such as a circular waveguide feed poly-rod antenna is used as a primary radiator may be used as means for solving the problems discussed above, In the conventional multibeam antenna, moreover, received-signal cables extending from converters for primary radiators are connected to an external switching device, and one satellite broadcasting program which is to be received is selected by controlling the switching operation of the switching device. This configuration involves problems in that the user must purchase such an external switching device, and that a wiring work and the like are required.

When an integral converter is configured by using plural primary radiators, substrate-printed probes 202 are formed on a single substrate 201 as shown in FIG. 29, and all other circuits also are disposed on the substrate 201. Each of the substrate-printed probes 202 comprises a horizontally-polarized-wave probe 202*a* and a vertically-polarized-wave probe 202*b*. The substrate-printed probes 202 are disposed in power feeding portions of plural (for example, two) primary radiator apertures 203, respectively. Signals output from the horizontally-polarized-wave probe 202*a* and the vertically-polarized-wave probe 202*b* are amplified by high-frequency amplifiers 203*a* and 203*b*, and then subjected to selection by horizontal/vertical changeover switches 204*a* and 204*b*. Signals which are selected by the horizontal/vertical changeover switches 204*a* and 204*b* are then subjected to further selection by a satellite changeover switch 205. The selected signal is amplified by a high-frequency amplifier 206, and then supplied to a frequency converter 207. The oscillation output of a local oscillator 208 is supplied to the frequency converter 207. The frequency converter 207 outputs, as an intermediate-frequency signal, a signal of a frequency which is equal to the difference in frequency between the signal from the high-frequency amplifier 206 and that from the local oscillator 208. The signal output from the frequency converter 207 is amplified by an intermediate-frequency amplifier 209. The amplified signal is supplied to the outside through a terminal 210.

The conventional multibeam antenna has problems in that the arrangement inclination angles of primary radiators must be respectively adjusted, and that the reception polarization angles of the primary radiators must be respectively adjusted.

The conventional multibeam antenna has a further problem in that, in the case where satellites from which micro waves are to be received are separated from each other by a small distance of, for example, 4 deg., flaring horn type primary radiators which are adjacently arranged contact or interfere with each other and therefore cannot constitute a multibeam antenna.

The conventional multibeam antenna has a further problem in that, in order to selectively receive a desired satellite broadcasting program, an external switching device, wirings for the device, and the like are required.

Furthermore, in the conventional primary radiator, a current supplied from a feeding point flows into a rear side through an edge portion of a horn aperture or that of a ground plane of a helical antenna, thereby causing the primary radiator to have radiational patterns in which radiation other than that to a reflector is large. As a result, the antenna gain is lowered.

When micro waves from plural satellites are to be received by the conventional converter for receiving micro waves from satellites, the substrate-printed probes 202 are set so that an axis which is in parallel with the ground in each area, the orbit inclinations of the objective satellites, and the polarization angles of the satellites coincide with each other. In this case, the converter is dedicated to the satellites from which micro waves are to be received. When converters corresponding to all satellites are to be produced, therefore, the converters cannot entirely share substrates, with the result that the productivity is impaired and hence the production cost of a converter is increased.

SUMMARY OF THE INVENTION

The invention has been conducted in view of these problems. It is a first object of the invention to provide a multibeam antenna in which the arrangement inclination angle of primary radiators and the reception polarization angle can be easily adjusted.

It is a second object of the invention to provide a multibeam antenna in which, even in the case where satellites from which micro waves are to be received are separated from each other by a small elongation of, for example, 4 deg., horns of primary radiators do not interfere nor contact with each other, and a configuration for receiving multibeams can be constituted.

It is a third object of the invention to provide a multibeam antenna in which a desired satellite broadcasting program can be easily selected so as to be received, without requiring an external switching device, wirings, and the like to be disposed.

It is a fourth object of the invention to provide a primary radiator of a small gain reduction in a small-diameter multibeam antenna for a small separation, and a converter for receiving micro waves from satellites with which a primary radiator is integrated.

It is a fifth object of the invention to provide a converter for receiving micro waves from satellites which, even when micro waves from plural satellites are to be received, can use a common substrate, so that the productivity is improved and hence the production cost can be reduced.

According to a first aspect of the invention, there is provided a multibeam antenna comprise: a reflector which reflects and focuses micro waves from plural satellites; plural horn type primary radiators which receive the plural satellite micro waves which are reflected and focused by the reflector, respectively; a converter to which the plural horn type primary radiators are adjacently integrally attached, and which converts and amplifies satellite signals respectively received by the primary radiators; probes respectively for the primary radiators, the probes being arranged at an angle difference corresponding to a difference in polarization angle among the plural satellites under a state where the plural primary radiators are attached to the converter; a radiator supporting arm which supports the converter so that horns of the plural primary radiators are oriented to a direction of reflection of the reflector; and a rotation mechanism which is disposed between the radiator supporting arm and the converter, and which adjusts a rotation position of the converter so that an arrangement inclination angle of the primary radiators with respect to an axis which is in parallel with a ground, the arrangement inclination angle of the plural primary radiators, and a reception polarization angle of each of the radiators being simultaneously adjusted by the rotation mechanism.

According to a second aspect of the invention, there is provided the multibeam antenna of the first aspect wherein, the primary radiator is a circular waveguide aperture horn, and a dielectric part is attached to an aperture of the horn.

According to a third aspect of the invention, there is provided the multibeam antenna of the first or second aspect further comprising receiving satellite switching means for, in accordance with external instructions, selecting one of the plural satellite signals received by the plural primary radiators, and outputting the selected signal.

According to a fourth aspect of the invention, there is provided a primary radiator of an antenna for receiving micro waves from satellites comprising: two or more primary radiator apertures which are juxtaposed with maintaining predetermined intervals; and at least one choke which is commonly disposed on outer peripheries of the plural apertures, the choke having a depth of about one quarter of a wavelength.

According to this configuration, the edge portion of the aperture face has theoretically an infinite impedance, and hence a current which rearward flows from the edge portion of the aperture face can be suppressed, thereby preventing radiation toward the rear side of the primary radiator from occurring. Therefore, micro waves from plural satellites can be efficiently received.

According to a fifth aspect of the invention, there is provided a converter for receiving micro waves from satellites which integrated with two or more primary radiator apertures for receiving micro waves transmitted from two or more satellites by means of an antenna, and which comprises: a substrate on which a converter circuit portion is formed; substrate-printed probe substrates which respectively correspond to the primary radiator apertures, and which are rotatably disposed on and independently from the substrate; and substrate-printed probes which are respectively disposed on the substrate-printed probe substrates, and which are connected to the converter circuit portion, a rotation angle of each of the substrate-printed probe substrates being able to be set in accordance with the satellites.

Each of the substrate-printed probes comprises a horizontally-polarized-wave probe and a vertically-polarized-wave probe, and the converter circuit portion comprises first switching means for switching over the horizontally-polarized-wave probe and the vertically-polarized-wave probe, and second switching means for switching over the substrate-printed probes.

In the invention, a converter for receiving micro waves from satellites which is integrated with two or more primary radiator apertures for receiving micro waves transmitted from two or more satellites by means of an antenna comprises: a substrate on which a converter circuit portion is formed; a first substrate-printed probe which corresponds to one of the primary radiator apertures that is used for receiving a micro wave from one of the satellites, and which is disposed on the substrate; substrate-printed probe substrates which respectively correspond to the other one or more primary radiator apertures, and which are rotatably disposed on and independently from the substrate; one or more second substrate-printed probes which are respectively disposed on the substrate-printed probe substrates; and switching means for switching over the first and second substrate-printed probes, the switching means being disposed in the converter circuit portion.

According to this configuration, the converter can be easily made coincident with the polarization angles of plural satellites, and the inclination angle which is the angle difference between an axis which is in parallel with the ground and the axis of the satellite orbit. Even when the polarization angles of adjacent two satellites are changed or when a satellite from which a micro wave is to be received is changed to another one, therefore, the converter can be easily made coincident with the polarization angle. Furthermore, the use of a common circuit can reduce the production cost.

DETAILED DESCRIPTION OF THE PREFERRED EMBODIMENTS

Hereinafter, an embodiment of the invention will be described with reference to the accompanying drawings.

First Embodiment

Figure 1B:
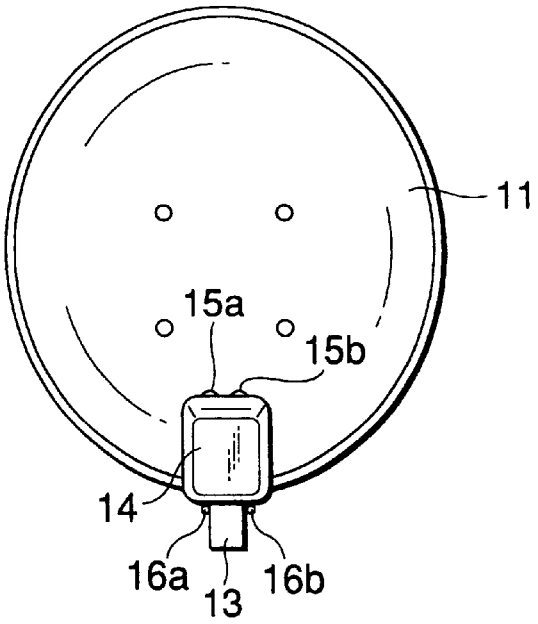
FIGS. 1(A), 1(B) and 1(C) are side, front and top views of an external configuration of a multibeam antenna which is an embodiment of the invention.
Figure 1A:
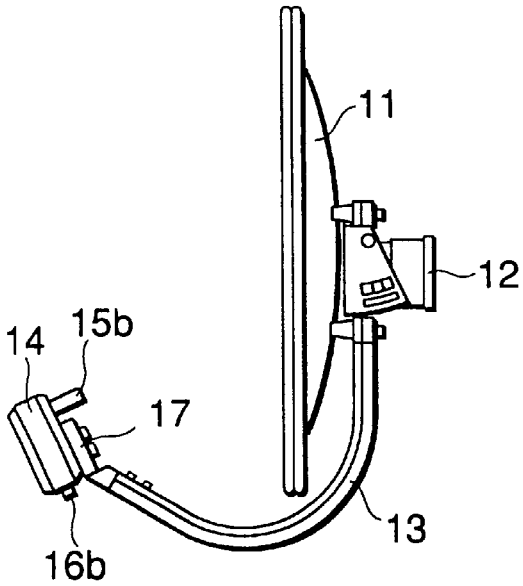
Figure 1C:
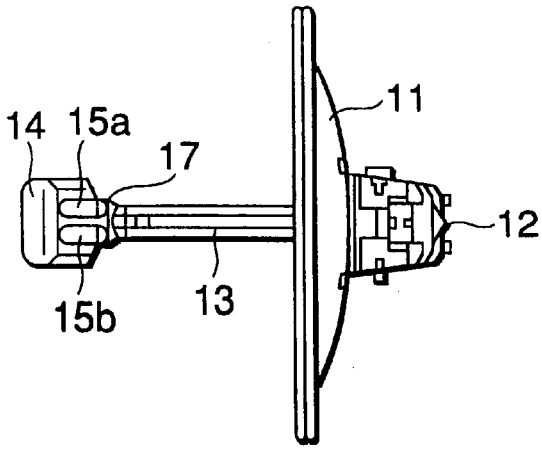

FIGS. 1(A) to 1(C) show the external configuration of a multibeam antenna which is an embodiment of the invention.

In FIG. 1, 11 designates a reflector, 12 designates an antenna bracket, 13 designates a radiator supporting arm, 14 designates a converter, and 15*a* and 15*b* designate horn type primary radiators which respectively receive different satellite signals.

Each of the horn type primary radiators 15*a* and 15*b* comprises a circular waveguide aperture horn. Both the first and second primary radiators 15*a* and 15*b* are integrally attached to the single converter 14.

Two satellite micro waves which are reflected and focused by the reflector 11 independently enter the first and second primary radiators 15*a* and 15*b*, respectively, and then couplingly received by the respective radiator probes. The received micro waves are converted into electric signals and amplified by a converting circuit incorporated in the converter 14, and then guided to a receiving tuner by cables via output connecting plugs 16*a* and 16*b*.

Figure 2C:
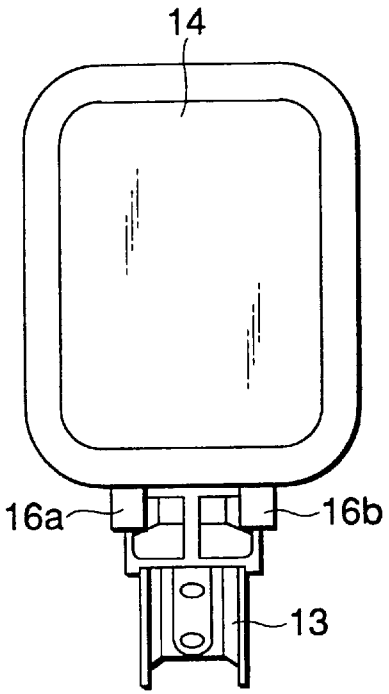
FIGS. 2(A), 2(B) and 2(C) are front, right side and rear views of an external configuration of mounting primary radiators and a converter on a radiator supporting arm in the multibeam antenna.
Figure 2B:
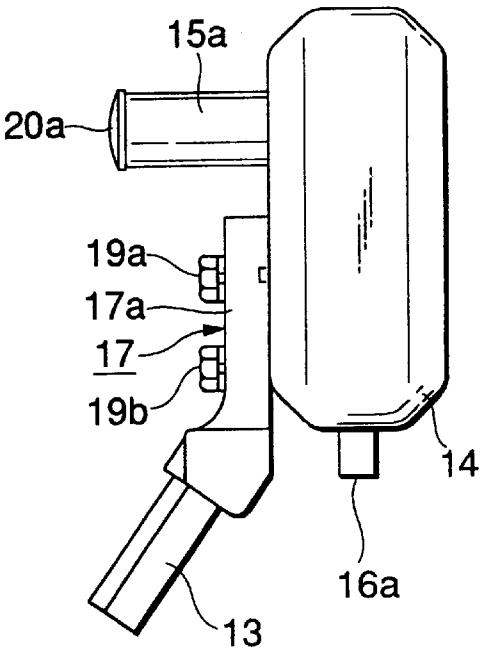
Figure 2A:
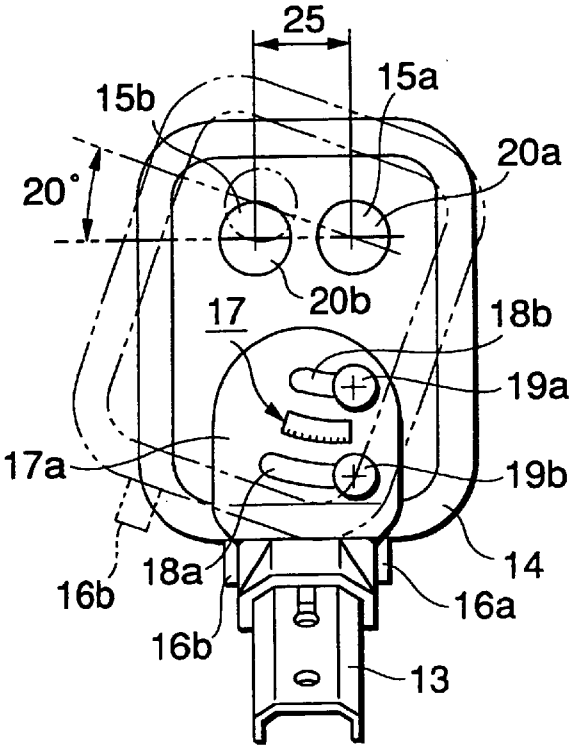

FIGS. 2(A) to 2(C) show the external configuration of mounting the primary radiators 15*a* and 15*b* and the converter 14 on the radiator supporting arm in the multibeam antenna. FIG. 2(A) is a front view on the side of the primary radiators, 2(B) is a right side view, and 2(C) is a rear view.

The converter 14 is attached to the radiator supporting arm 13 via a rotation mechanism 17. The rotation mechanism 17 comprises: an angle indication plate 17*a* which enables the whole of the converter 14 to be adjustingly rotated within a fixed angle range in a clockwise direction about the first primary radiator 15*a* as seen the converter 14 from the front; and fixing screws 19*a* and 19*b* which are to be respectively passed through long and short holes 18*a* and 18*b* of the angle indication plate 17*a* and then fastened. In the case where linearly polarized waves from two satellites which are over the equator at an altitude of about 36,000 km and separated from each other by a small distance or at 124 deg. and 128 deg. of east longitude are to be reflected and focused by the reflector 11 of a small diameter of 45 cm $\phi$ to be received, for example, the arrangement interval between the primary radiators 15*a* and 15*b* on the converter 14 is set to be 25 mm, and the rotation mechanism 17 is configured so that the arrangement inclination angle of the first and second primary radiators 15*a* and 15*b* with respect to an axis which is in parallel with the ground can be rotatingly adjusted from 0 to 20 deg.

Lens-like dielectric covers 20*a* and 20*b* are attached to horn cover portions of the primary radiators 15*a* and 15*b*, respectively.

Figure 3:
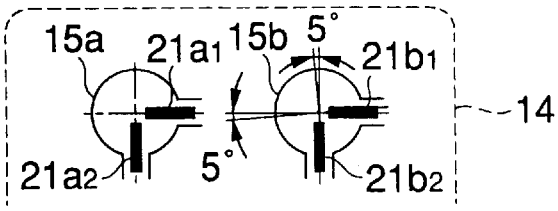
FIG. 3 is a view showing set angles of probes of first and second primary radiators which are arranged integrally with the converter of the multibeam antenna, as seen from the rear side of the converter.

FIG. 3 is a view showing set angles of probes $\mathbf{21}_{a1}$, $\mathbf{21}_{a2}$, $\mathbf{21}_{b1}$, and $\mathbf{21}_{b2}$ of the first and second primary radiators 15*a* and 15*b* which are arranged integrally with the converter 14 of the multibeam antenna, as seen from the rear side of the converter 14.

Under the state where the arrangement inclination angle of the first and second primary radiators 15*a* and 15*b* is set to be 0 deg. or in parallel with the ground, the probes $\mathbf{21}_{a1}$ and $\mathbf{21}_{a2}$ of the first primary radiator 15*a* are set to be respectively parallel and perpendicular to the ground, and the probes $\mathbf{21}_{b1}$ and $\mathbf{21}_{b2}$ of the second primary radiator 15*b* are set to be respectively offset by 5 deg. with respect to the probes $\mathbf{21}_{a1}$ and $\mathbf{21}_{a2}$ of the first primary radiator 15*a*.

The set angle difference of 5 deg. among the probes $\mathbf{21}_{a1}$, $\mathbf{21}_{a2}$, $\mathbf{21}_{b1}$, and $\mathbf{21}_{b2}$ of the first and second primary radiators 15*a* and 15*b* is set in accordance with the difference between the polarization angle of one of the satellites and that of the other satellite.

Specifically, when the converter 14 of the thus configured multibeam antenna is rotated by means of the rotation mechanism 17, the arrangement inclination angle of the two primary radiators 15*a* and 15*b* can be adjusted in the range of 0 to 20 deg. with respect to an axis which is in parallel with the ground. Also the reception polarization angles due to the probes $\mathbf{21}_{a1}$, $\mathbf{21}_{a2}$, $\mathbf{21}_{b1}$, and $\mathbf{21}_{b2}$ of the primary radiators 15*a* and 15*b* can be adjusted in the range of 0 to 20 deg. while maintaining the angle difference of 5 deg.

According to the multibeam antenna having the above-described configuration, therefore, the arrangement inclination angle of the primary radiators 15*a* and 15*b* for respectively receiving signals from the two satellites, and the reception polarization angles in the primary radiators 15*a* and 15*b* can be simultaneously easily adjusted by rotating the converter 14 by means of the rotation mechanism 17.

According to the multibeam antenna having the above-described configuration, furthermore, circular waveguide aperture horns are used as the primary radiators 15*a* and 15*b*. Even when the arrangement interval in the converter 14 is as small as, for example, 25 mm, therefore, the primary radiators can be integrally attached to the converter without causing the horns to contact or interfere with each other. Also for satellites which are separated from each other by a small distance of, for example, 4 deg., it is possible to realize a multibeam antenna.

In this case, since the lens-like dielectric covers 20*a* and 20*b* are respectively attached to the horn cover portions of the primary radiators 15*a* and 15*b* realized by circular waveguide aperture horns, degradation of antenna properties, such as reduction of the antenna efficiency which may be caused by a leakage power from the reflector 11, and spill-over degradation in the radiational patterns can be prevented from occurring.

In the embodiment, the primary radiators 15*a* and 15*b* which receive the two reflected satellite micro waves are arranged on and integrally attached to the single converter 14. When a switching device for switching over the satellite from which a micro wave is to be received, in accordance with a satellite selection signal from the tuner is incorporated in the single converter substrate for receiving and amplifying the two satellite broadcasting signals, two satellite programs can be selectively received by using an output of a single cable without requiring an external switching device or the like.

Figure 4:
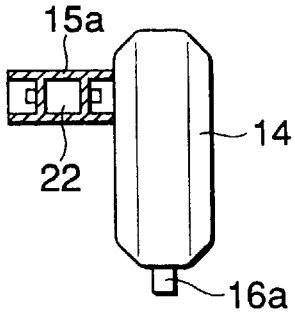
FIG. 4 is a partial section view showing a configuration in which a polarizer is inserted into each of the primary radiators of the multibeam antenna and realized by circular waveguide aperture horns.

FIG. 4 is a partial section view showing a configuration in which a polarizer 22 is inserted into each of the primary radiators 15*a* and 15*b* of the multibeam antenna and realized by the circular waveguide aperture horns.

The insertion of the polarizer 22 into each of the primary radiators 15*a* and 15*b* allows the reception polarization angle to be arbitrarily adjusted without conducting angle adjustment on the probes $\mathbf{21}_{a1}$, $\mathbf{21}_{a2}$, $\mathbf{21}_{b1}$, and $\mathbf{21}_{b2}$ of the primary radiators 15*a* and 15*b*.

Figure 5:
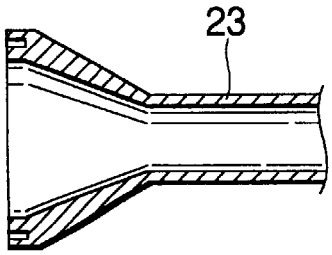
FIG. 5 is a sectional side view showing a flare aperture horn type primary radiator.

FIG. 5 is a sectional side view showing a flare aperture horn type primary radiator 23.

Figure 6:
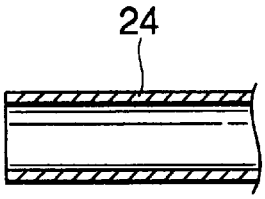
FIG. 6 is a sectional side view showing a circular waveguide aperture horn type primary radiator.

FIG. 6 is a sectional side view showing a circular waveguide aperture horn type primary radiator 24.

Figure 7:
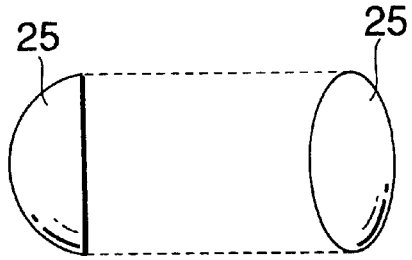
FIG. 7 is a view showing the configuration of a dielectric lens which is used as a horn cover portion of the circular waveguide aperture horn type primary radiator.

FIG. 7 is a view showing the configuration of a dielectric lens 25 which is used as a horn cover portion of the circular waveguide aperture horn type primary radiator 24.

Figure 8A:
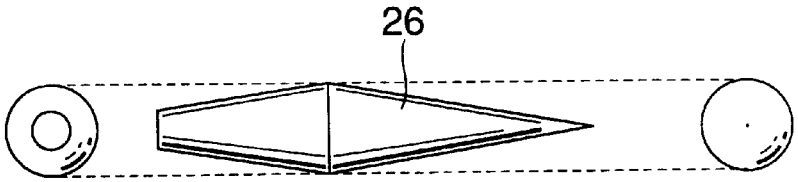
FIGS. 8(A) shows three side views of a configuration of a dielectric rod which is to be attached to the circular waveguide aperture horn type primary radiator; and 8(B) is a partial section view showing the state of attaching the rod.
Figure 8B:
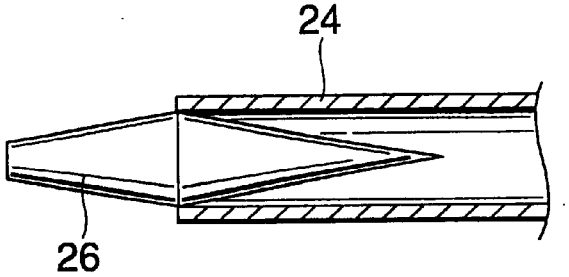

FIGS. 8(A) and 8(B) show the configuration of a dielectric rod 26 which is to be attached to the circular waveguide aperture horn type primary radiator 24. FIG. 8(A) shows three side views of the rod, and 8(B) is a partial section view showing the state of attaching the rod.

When flare aperture horn type primary radiators 23 such as shown in FIG. 5 are used as the primary radiators which are arranged on and adjacently integrally attached to the single converter 14, so as to configure a multibeam antenna for two satellites of a small distance, also the arrangement interval between the two radiators 23 is reduced and hence the radiators contact or interfere with each other, with the result that the radiators cannot be attached to the converter. To comply with this, the circular waveguide aperture horn type primary radiators 24 such as shown in FIG. 6 are used, so that a multibeam antenna for two satellites of a small distance can be configured without causing the primary radiators to contact with each other even in the case of a small arrangement interval.

In this case, the dielectric lens 25 such as shown in FIG. 7, or the dielectric rod 26 such as shown in FIG. 8 may be attached to the circular waveguide aperture horn type primary radiator 24. According to this configuration, it is possible to realize a multibeam antenna having a high-efficiency low-noise converter.

Second Embodiment

Figure 9A:
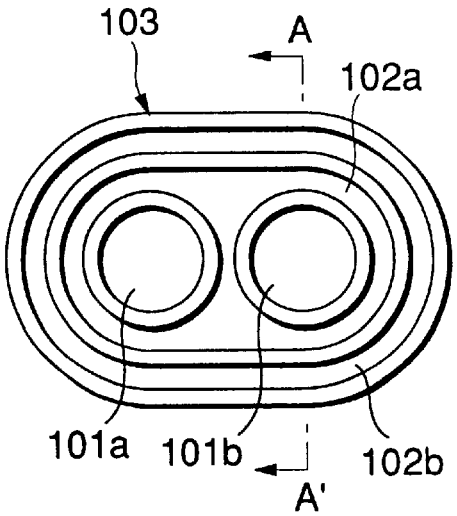
FIG. 9(A) is a front view of a primary radiator of an antenna for receiving micro waves from satellites which is a second embodiment of the invention.
Figure 9B:
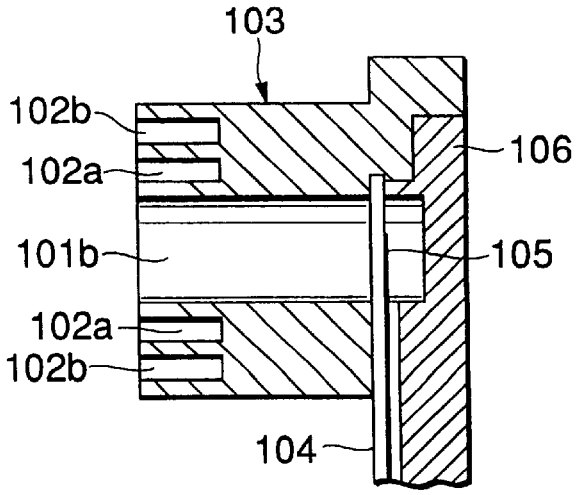
FIG. 9(B) is a section view taken along the line A–A' of FIG. (A)

FIG. 9(A) is a front view of a primary radiator of a small-diameter multibeam antenna for receiving micro waves from satellites which is a second embodiment of the invention, and FIG. 9(B) is a section view taken along the line A–A' of FIG. 9(A).

In FIGS. 9(A) and 9(B), 101*a* and 101*b* designate circular waveguides which have a predetermined length and which are integrally disposed with maintaining an interval of several millimeters. The circular waveguides 101*a* and 101*b* form apertures of the primary radiator. A first choke 102*a* which is configured by a groove having a depth of about one quarter of the wavelength is formed on outer peripheries of the circular waveguides 101*a* and 101*b*. A second choke 102*b* which is configured in a similar manner as the first choke 102*a* is formed on the outer periphery of the first choke. The circular waveguides 101*a* and 101*b*, and the chokes 102*a* and 102*b* constitute a primary radiator 103. A substrate 104 is disposed on the bottoms of the circular waveguides 101*a* and 101*b*. A feeding point 105 is disposed by a printed circuit formed on the substrate 104, so as to be positioned at the center of the bottoms of the circular waveguides 101*a* and 101*b*. A terminal portion 106 is formed on the bottom face of the primary radiator 103. For example, the primary radiator 103 and the terminal portion 106 are made of aluminum or the like.

When the primary radiator 103 is used as a primary radiator of a 45-cm ϕ dual-beam antenna system which receives micro waves of the 12 GHz band from two satellites of an distance of 4 deg., for example, the circular waveguides 101*a* and 101*b* are set to have an inner diameter of 17.475 mm and their center interval is set to be about 25 mm.

When the chokes 102*a* and 102*b* are formed around the circular waveguides 101*a* and 101*b* as described above, the edge portion of the aperture face formed by the circular waveguides 101*a* and 101*b* has theoretically an infinite impedance, and hence a current which rearward flows from the edge portion of the aperture face can be suppressed, thereby preventing radiation toward the rear side of the primary radiator 103 from occurring. As a result, the amount of a power leaking from the reflector is reduced, and hence it is possible to obtain an antenna gain which is substantially equal to that in the case where usual flare horns are used.

Figure 10:
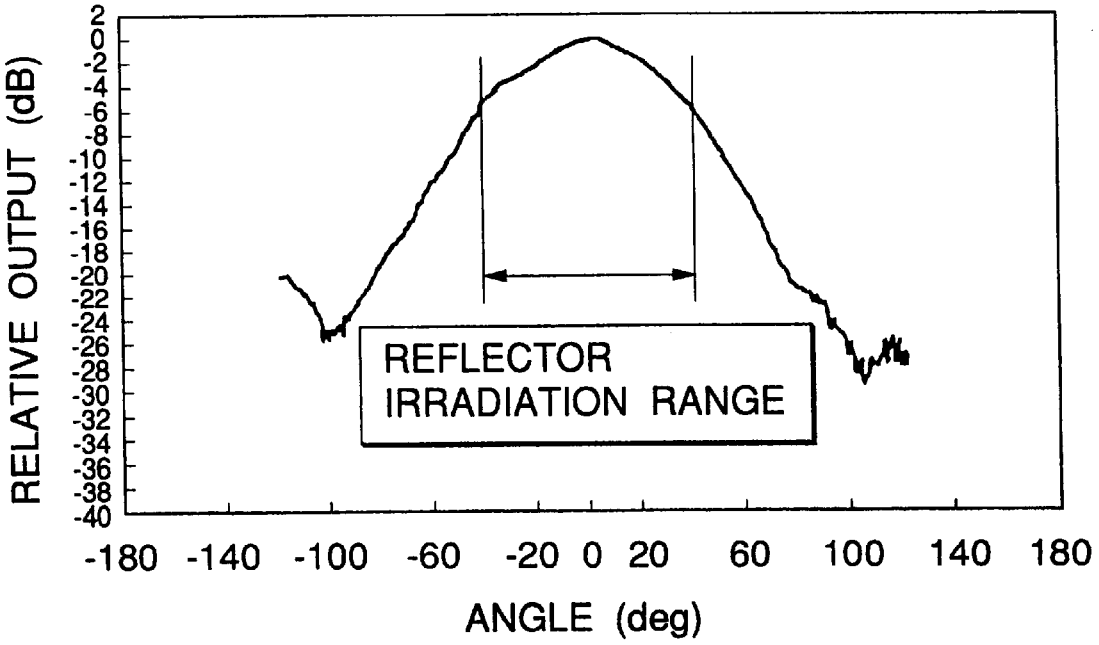
FIG. 10 is a view showing the radiational pattern of the primary radiator of the embodiment.

FIG. 10 shows the radiational pattern of the primary radiator.

Figure 24:
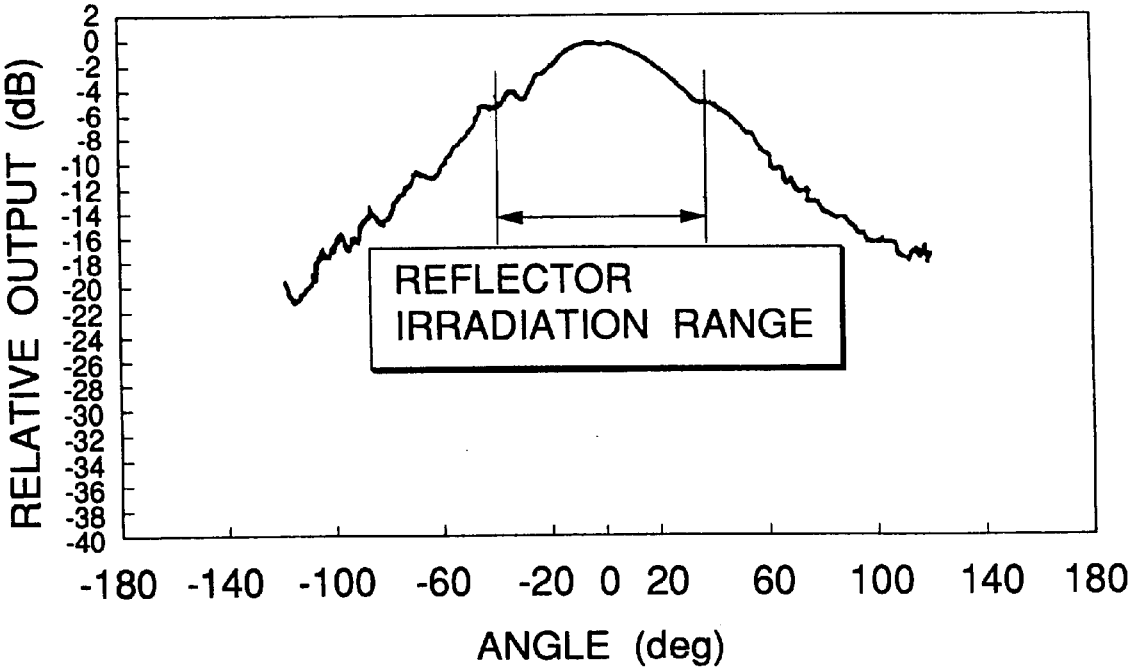
FIG. 24 is a view showing the radiational pattern of a conventional primary radiator.

As compared with the conventional radiational pattern shown in FIG. 24, the leakage power and the unevenness of the electric field in the reflector irradiation range are improved. The antenna gain of the embodiment is substantially equal to that in the case where flare horns are used.

Figure 11:
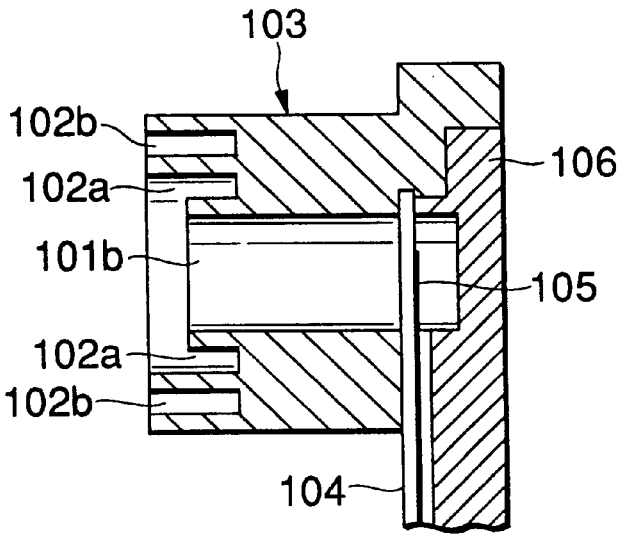
FIG. 11 is a front view showing an application example of the primary radiator of the embodiment.

As shown in FIG. 11, the first choke 102*a* which is adjacent to the circular waveguides 101*a* and 101*b* may be sometimes formed so that the boundary walls between the choke and the circular waveguides 101*a* and 101*b* are made lower than the wall between the first and second chokes 102*a* and 102*b* in order to attain the impedance matching.

In the embodiment, even when horns of a small flare angle are used in place of the circular waveguides 101*a* and 101*b*, the same effects can be attained.

Third Embodiment

Figure 12:
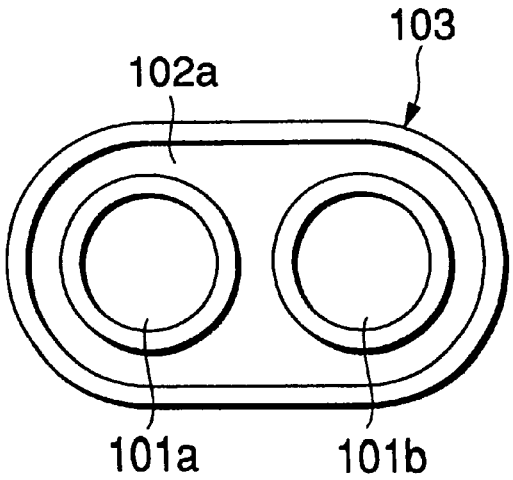
FIG. 12 is a front view of a primary radiator of an antenna for receiving micro waves from satellites which is a third embodiment of the invention.

A third embodiment of the invention will be described. FIG. 12 is a front view of a primary radiator 103 which is a second embodiment of the invention.

The third embodiment is configured by modifying the primary radiator 103 of the second embodiment so that the second choke 102*b* is removed away. In the primary radiator 103 of the second embodiment, the radiational pattern are not improved to a level of the radiational pattern of the second embodiment shown in FIG. 10, but the antenna efficiency is improved to a level of about 60%.

Fourth Embodiment

Figure 13:
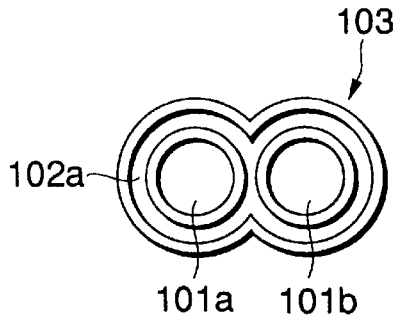
FIG. 13 is a front view of a primary radiator of an antenna for receiving micro waves from satellites which is a fourth embodiment of the invention.
Figure 14:
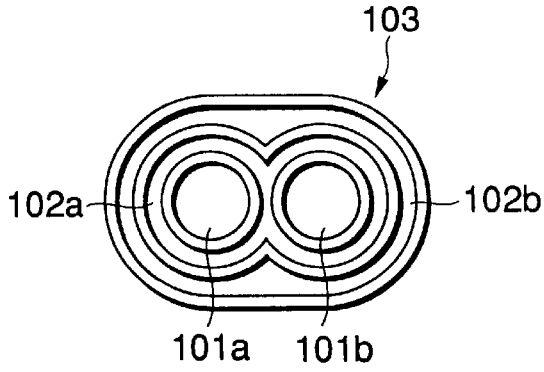
FIG. 14 is a front view showing an application example of the primary radiator of the embodiment.
Figure 15:
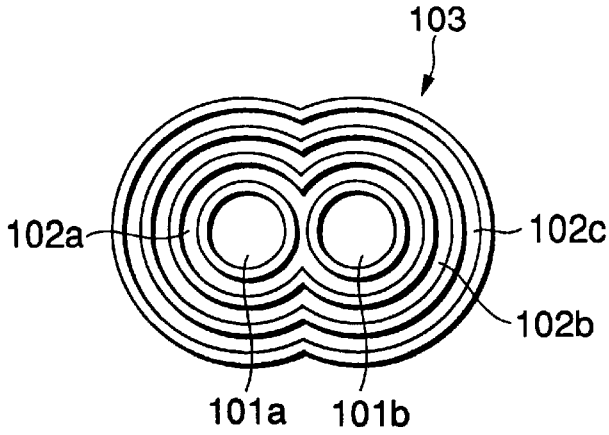
FIG. 15 is a front view showing another application example of the primary radiator of the embodiment.

FIGS. 13, 14 and 15 are front views of a primary radiator 103 which is a fourth embodiment of the invention. The primary radiator 103 of the fourth embodiment is configured so that, in order to prevent the radiational pattern of FIG. 10 from becoming laterally asymmetric, the shapes of the chokes 102 (102*a*, 102*b*, . . . ) are configured by circles centered at respective circular waveguides and the crossing portions of the circles are removed away.

FIG. 13 shows an example in which only a first choke 102*a* is disposed, FIG. 14 shows an example in which first and second chokes 102*a* and 102*b* are disposed, and FIG. 15 shows an example in which first, second, and third chokes 102*a*, 102*b*, and 102*c* are disposed. In the example shown in FIG. 14, the second choke 102*b* which is disposed in the outer side has a similar shape as that of the second embodiment. Alternatively, the second choke may be formed on circles respectively centered at the circular waveguides in the same manner as the first choke 102*a*.

Fifth Embodiment

Figure 16:
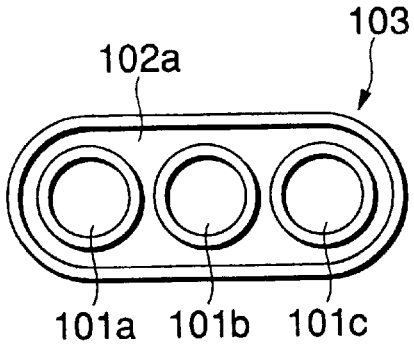
FIG. 16 is a front view of a primary radiator of an antenna for receiving micro waves from satellites which is a fifth embodiment of the invention.
Figure 17:
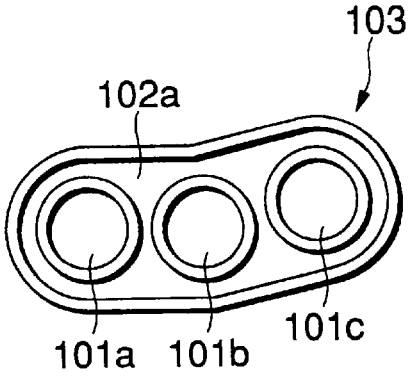
FIG. 17 is a front view showing an application example of the primary radiator of the embodiment.
Figure 18:
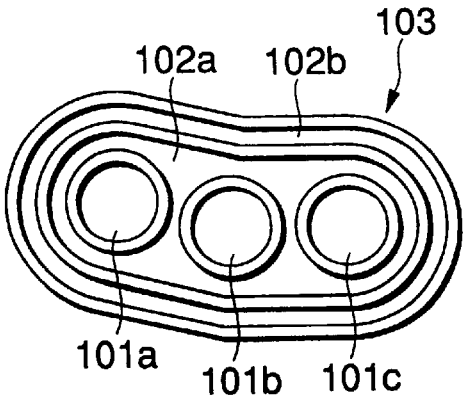
FIG. 18 is a front view showing another application example of the primary radiator of the embodiment.

FIGS. 16, 17 and 18 are front views of a primary radiator 103 which is a fifth embodiment of the invention. In the fifth embodiment, the primary radiator 3 is configured so as to receive micro waves from three satellites.

FIG. 16 shows an example in which one choke 102*a* is disposed outside circular waveguides 101*a*, 101*b*, and 101*c*.

FIG. 17 shows an example in which one choke 102*a* is disposed outside the circular waveguides 101*a*, 101*b*, and 101*c* and the circular waveguides 101*a*, 101*b*, and 101*c* are arranged into "an angled shape" in accordance with differences of the elevation angles of the satellites. For example, the apertures are arranged into "an angled shape" With using the extension line of the two circular waveguides 101*a* and 101*b*, so as to correspond with the elevation angles of the satellites.

FIG. 18 shows an example in which two chokes 102*a* and 102*b* are disposed outside the circular waveguides 101*a*, 101*b*, and 101*c* and the circular waveguides 101*a*, 101*b*, and 101*c* are arranged into "an angled shape" in accordance with differences of the elevation angles of the satellites.

Sixth Embodiment

Figure 19A:
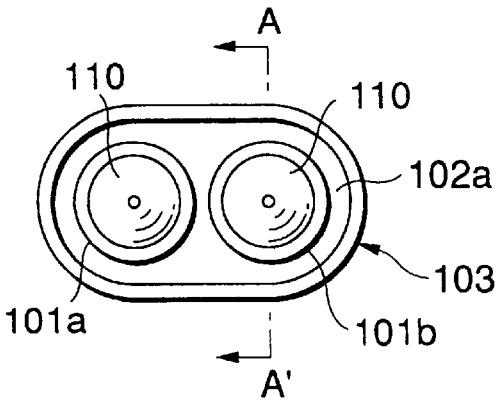
FIG. 19(A) is a front view of a primary radiator of an antenna for receiving micro waves from satellites which is a sixth embodiment of the invention.
Figure 19B:
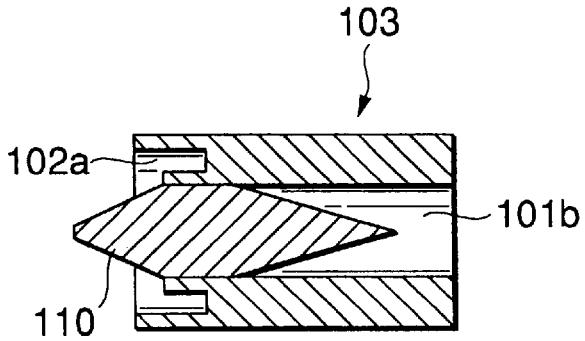
FIG. 19(B) is a section view taken along the line A–A' of FIG. 19(A)

FIG. 19(A) is a front view of a primary radiator which is a sixth embodiment of the invention, and FIG. 19(B) is a section view taken along the line A–A' of FIG. 19(A).

In the sixth embodiment, in order to focus beams, a dielectric member 110 is loaded into each of circular waveguides 101*a* and 101*b*. In this example, one choke 102*a* is disposed.

Seventh Embodiment

Figure 20A:
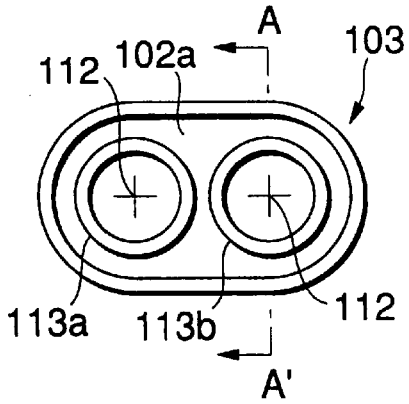
FIG. 20(A) is a front view of a primary radiator of an antenna for receiving micro waves from satellites which is a seventh embodiment of the invention.
Figure 20B:
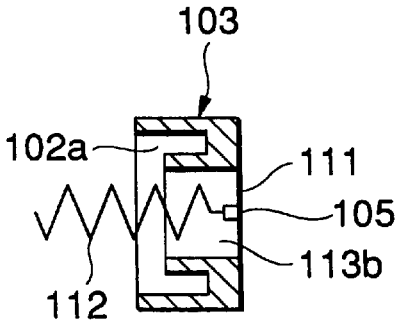
FIG. 20(B) is a section view taken along the line A–A' of FIG. 20(A)

FIG. 20(A) is a front view of a primary radiator which is a seventh embodiment of the invention, and FIG. 20(B) is a section view taken along the line A–A' of FIG. 20(A).

In the seventh embodiment, helical antennas 112 such as dipole antennas, helical antennas, or bent antennas are attached to a ground plane 111. Specifically, the ground plane 111 is formed by using aluminum or the like, and plural (for example, two) circular apertures 113*a* and 113*b* are disposed on the ground plane with maintaining an interval of several millimeters. The helical antennas 112 are disposed at center portions of the apertures 113*a* and 113*b*, respectively. The power supply to the helical antennas 112 is conducted from a feeding point 105 disposed on the ground plane 111. A choke 102*a* having a depth of about one quarter of the wavelength is formed on the outer peripheries of the apertures 113*a* and 113*b*.

Also in the case where the helical antennas 112 are disposed as shown in the seventh embodiment, it is possible to attain the same effects as those of the embodiments described above.

In the seventh embodiment, the single choke 102 is disposed. It is a matter of course that plural chokes may be disposed in the same manner as the embodiments described above.

Eighth Embodiment

Figure 21A:
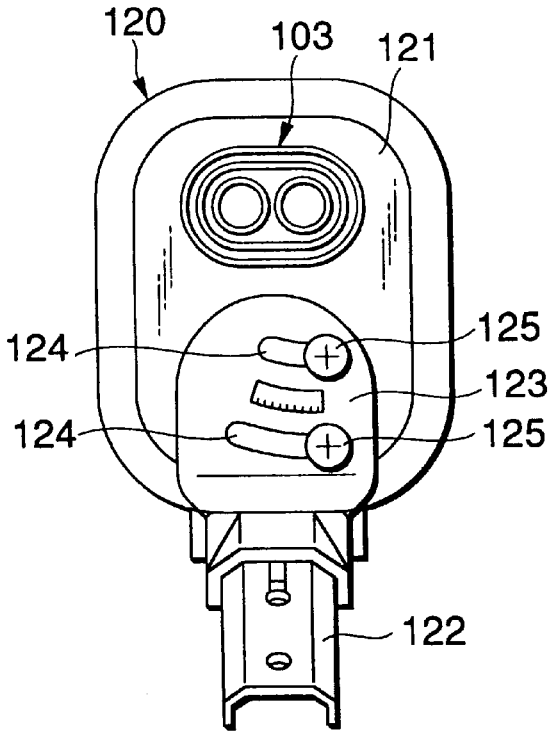
FIG. 21(A) is a front view of a converter for receiving micro waves from satellites according to an eighth embodiment of the invention.
Figure 21B:
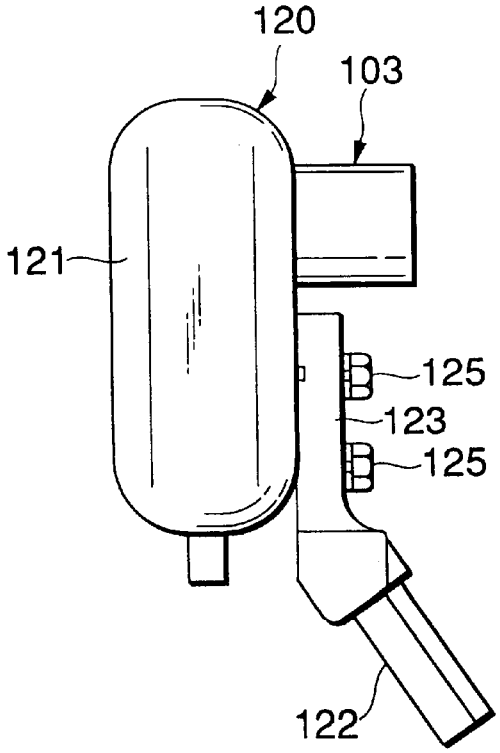
FIG. 21(B) is a side view of the converter.
Figure 22A:
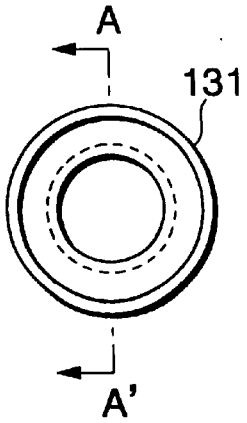
FIG. 22(A) is a front view of a conventional flare horn type primary radiator.
Figure 22B:
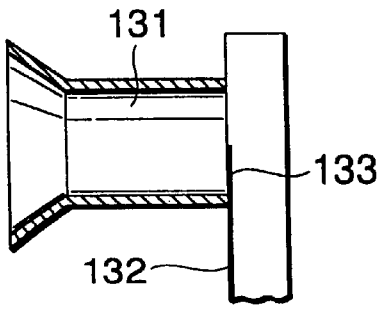
FIG. 22(B) is a section view taken along the line A–A' of FIG. 22(A)
Figure 23A:
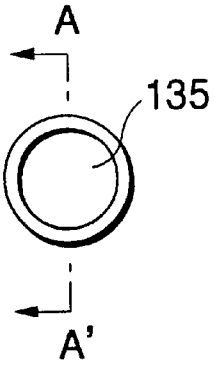
FIG. 23(A) is a front view of a conventional circular waveguide type primary radiator.
Figure 23B:
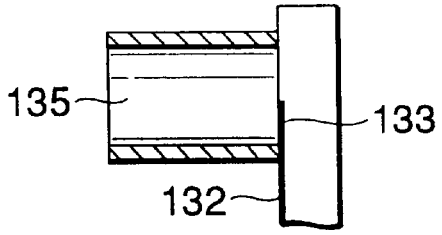
FIG. 23(B) is a section view taken along the line A–A' of FIG. 23(A)

FIGS. 21(A) and 21(B) show a case in which a converter 120 for receiving micro waves from satellites is configured by using the primary radiator 103 according to the invention. FIG. 21(A) is a front view of the converter 120 for receiving micro waves from satellites according to the eighth embodiment, and FIG. 21(B) is a side view of the converter.

In FIGS. 21(A) and 21(B), 121 designates a case which houses the main unit of the converter and which is attached to a reflector (not shown) via an arm 122. An angle adjustment mechanism 123 is disposed on a converter support portion using the arm 122. The attachment angle of the converter 120 can be adjusted by means of long holes 124 and screws 125. The primary radiator 103 described in the embodiments is attached to one face of the converter case 121, i.e., the face opposed to the reflector.

The configuration of the converter 120 for receiving micro waves from satellites in which the converter is integrated with the primary radiator 103 as described above enables micro waves from plural satellites to be received by the single converter 120, and the antenna system to be miniaturized.

Ninth Embodiment

Figure 25A:
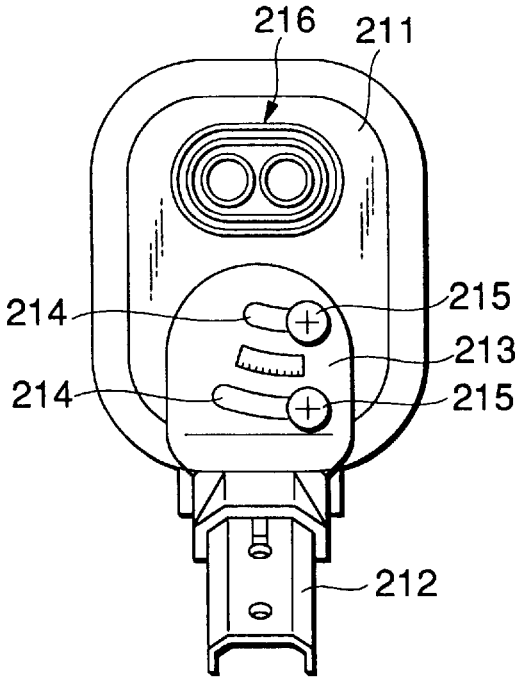
FIG. 25(A) is a front view showing the external configuration of the converter for receiving micro waves from satellites according to the invention.
Figure 25B:
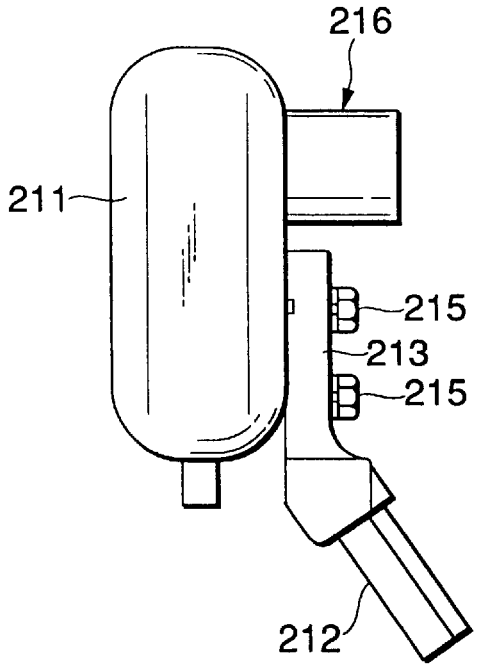
FIG. 25(B) is a side view of the converter.

FIGS. 25(A) and 25(B) show the whole configuration of a converter for receiving micro waves from satellites which is an embodiment of the invention. FIG. 25(A) is a front view of the converter, and FIG. 25(B) is a side view of the converter.

In FIGS. 25(A) and 25(B), 211 designates a case which houses the main unit of the converter and which is attached to a reflector (not shown) via an arm 212. An angle adjustment mechanism 213 is disposed on a converter support portion using the arm 212. The attachment angle of the converter 220 can be adjusted by means of long holes 214 and inclination angle adjusting screws 215. A primary radiator 216 is attached to one face of the converter case 211, i.e., the face opposed to the reflector.

Figure 26A:
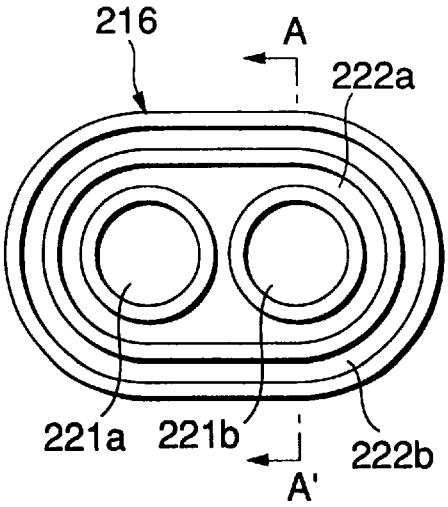
FIG. 26(A) is a front view of a primary radiator of the converter for receiving micro waves from satellites according to the invention.
Figure 26B:
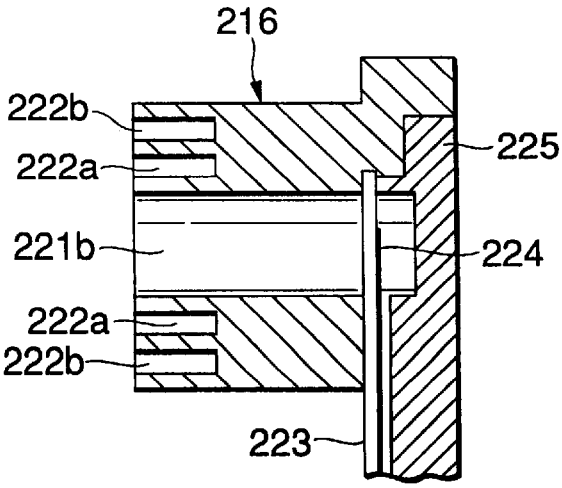
FIG. 26(B) is a section view taken along the line A–A' of FIG. 26(A)

The primary radiator 216 is configured in the manner shown in FIGS. 26(A) and 26(B). FIG. 26(A) is a front view of the primary radiator 216, and FIG. 26(B) is a section view taken along the line A–A' of FIG. 26(A).

In FIGS. 26(A) and 26(B), 221*a* and 221*b* designate circular waveguides which have a predetermined length and which are integrally disposed with maintaining an interval of several millimeters. The circular waveguides 221*a* and 221*b* form apertures of the primary radiator. A first choke 222*a* which is configured by a groove having a depth of about one quarter of the wavelength is formed on outer peripheries of the circular waveguides 221*a* and 221*b*. A second choke 222*b* which is configured in a similar manner as the first choke 222*a* is formed on the outer periphery of the first choke. A substrate 223 is disposed on the bottoms of the circular waveguides 221*a* and 221*b*. A feeding point 224 is disposed by a printed circuit formed on the substrate 223, so as to be positioned at the center of the bottoms of the circular waveguides 221*a* and 221*b*. A terminal portion 225 is formed on the bottom face of the primary radiator 216. For example, the circular waveguides 221*a* and 221*b* and the terminal portion 225 are made of aluminum or the like.

When the primary radiator 216 is used as a primary radiator of a 45-cm ϕ dual-beam antenna system which receives micro waves of the 12 GHz band from two satellites of a distance of 4 deg., for example, the circular waveguides 221*a* and 221*b* are set to have an inner diameter of 17.475 mm and their center interval is set to be about 25 mm.

Figure 27:
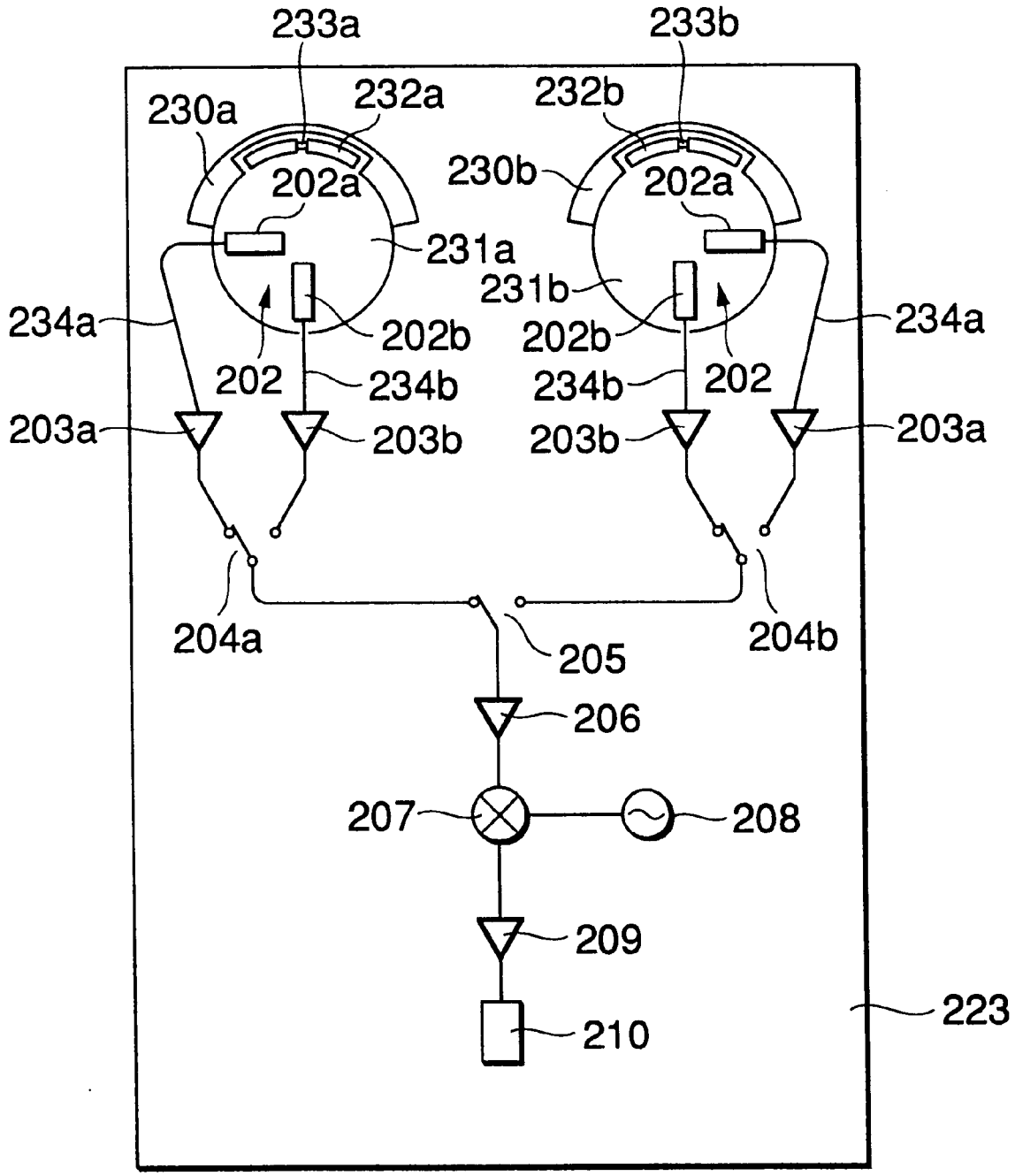
FIG. 27 is a view showing the circuit configuration of a converter for receiving micro waves from satellites which is a ninth embodiment of the invention.

A converter circuit portion shown in FIG. 27 is formed on the substrate 223.

In the substrate 223, the portions corresponding to the circular waveguides 221*a* and 221*b*, i.e., the primary radiator apertures are cut away in a substantially circular shape to form notched portions 230*a* and 230*b*, and substrate-printed probe substrates 231*a* and 231*b* which are substantially circular are rotatably disposed in the notched portions 230*a* and 230*b*, respectively. In each of the substrate-printed probe substrates 231*a* and 231*b*, for example, an upper portion is outward projected, and an arcuate groove 232*a* or 232*b* is formed in the projection. In the groove 232*a* or 232*b*, the substrate-printed probe substrate 231*a* or 231*b* is fixed to the substrate 223 by a screw 233*a* or 233*b*, in such a manner that, when the screw 233*a* or 233*b* is loosened, the substrate-printed probe substrate 231*a* or 231*b* can be laterally rotated by an angle corresponding to the length of the groove 232*a* or 232*b* at the maximum. After the rotation angle of the substrate-printed probe substrate 231*a* or 231*b* is adjusted, the substrate is fixed by the screw 233*a* or 233*b*.

In each of the substrate-printed probe substrates 231*a* and 231*b*, a substrate-printed probe 202 is formed at the feeding point of the circular waveguide 221*a* or 221*b*. Each of the substrate-printed probes 202 comprises a horizontally-polarized-wave probe 202*a* and a vertically-polarized-wave probe 202*b*. The probes are connected to a printed circuit formed on the substrate 223, via lead wires 234*a* and 234*b*. In this case, for example, wiring patterns on the substrate 223 may be formed into an arcuate shape so as to elongate along the outer edge of the substrate-printed probe substrates 231*a* and 231*b*, and the lead wires 234*a* and 234*b* may be connected to positions of the wiring patterns on the substrate 223 which are closest to the horizontally polarized wave 202*a* and the vertically-polarized-wave probe 202*b*. According to this configuration, the lead wires 234*a* and 234*b* can be shortened and the circuit characteristics can be improved. Alternatively, wiring patterns of the horizontally polarized wave 202*a* and the vertically-polarized-wave probe 202*b* may be pressingly contacted with the wiring patterns on the substrate 223 so as to be directly connected with each other.

Signals output from the horizontally-polarized-wave probe 202*a* and the vertically-polarized-wave probe 202*b* are amplified by high-frequency amplifiers 203*a* and 203*b*, and then subjected to selection by horizontal/vertical changeover switches 204*a* and 204*b*. Signals which are selected by the horizontal/vertical changeover switches 204*a* and 204*b* are then subjected to further selection by a satellite changeover switch 205. The selected signal is amplified by a high-frequency amplifier 206, and then supplied to a frequency converter 207. The oscillation output of a local oscillator 208 is supplied to the frequency converter 207. The frequency converter 207 outputs, as an intermediate-frequency signal, a signal of a frequency which is equal to the difference in frequency between the signal from the high-frequency amplifier 206 and that from the local oscillator 208. The signal output from the frequency converter 207 is amplified by an intermediate-frequency amplifier 209. The amplified signal is supplied to the outside through a terminal 210.

The configuration in which, as described above, the substrate-printed probe substrates 231*a* and 231*b* are independently disposed in addition to the substrate 223 and the rotation angles of the substrate-printed probe substrates can be arbitrarily adjusted enables the converter to be easily made coincident with the polarization angles of plural satellites, and the inclination angle which is the angle difference between an axis which is in parallel with the ground and the axis of the satellite orbit. Even when the polarization angles of adjacent two satellites are changed or when a satellite from which a micro wave is to be received is changed to another one, therefore, the converter can be easily made coincident with the polarization angle. Furthermore, the use of a common circuit can reduce the production cost.

Tenth Embodiment

Next, a tenth embodiment of the invention will be described.

Figure 28:
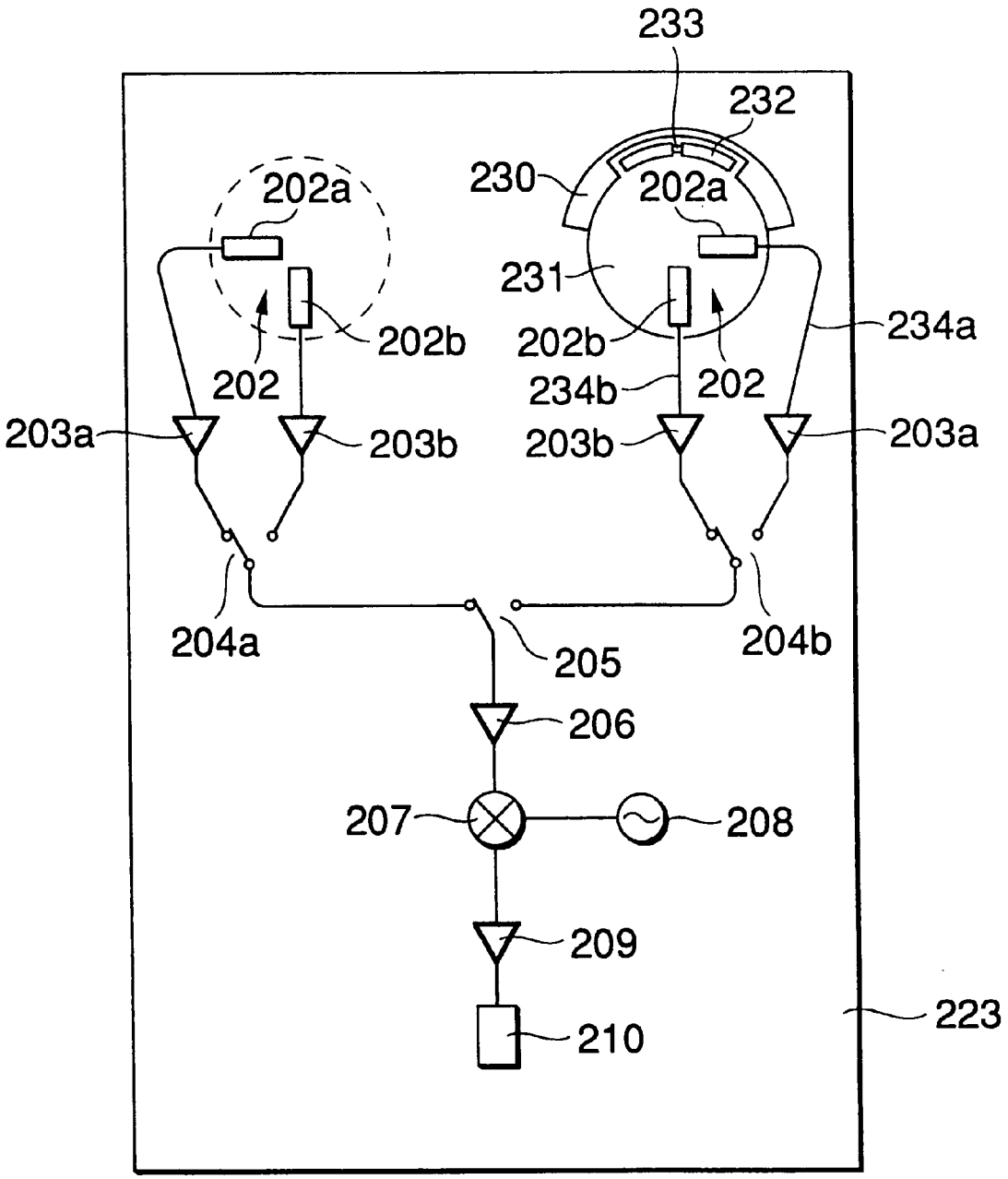
FIG. 28 is a view showing the circuit configuration of a converter for receiving micro waves from satellites which is a tenth embodiment of the invention.
Figure 29:
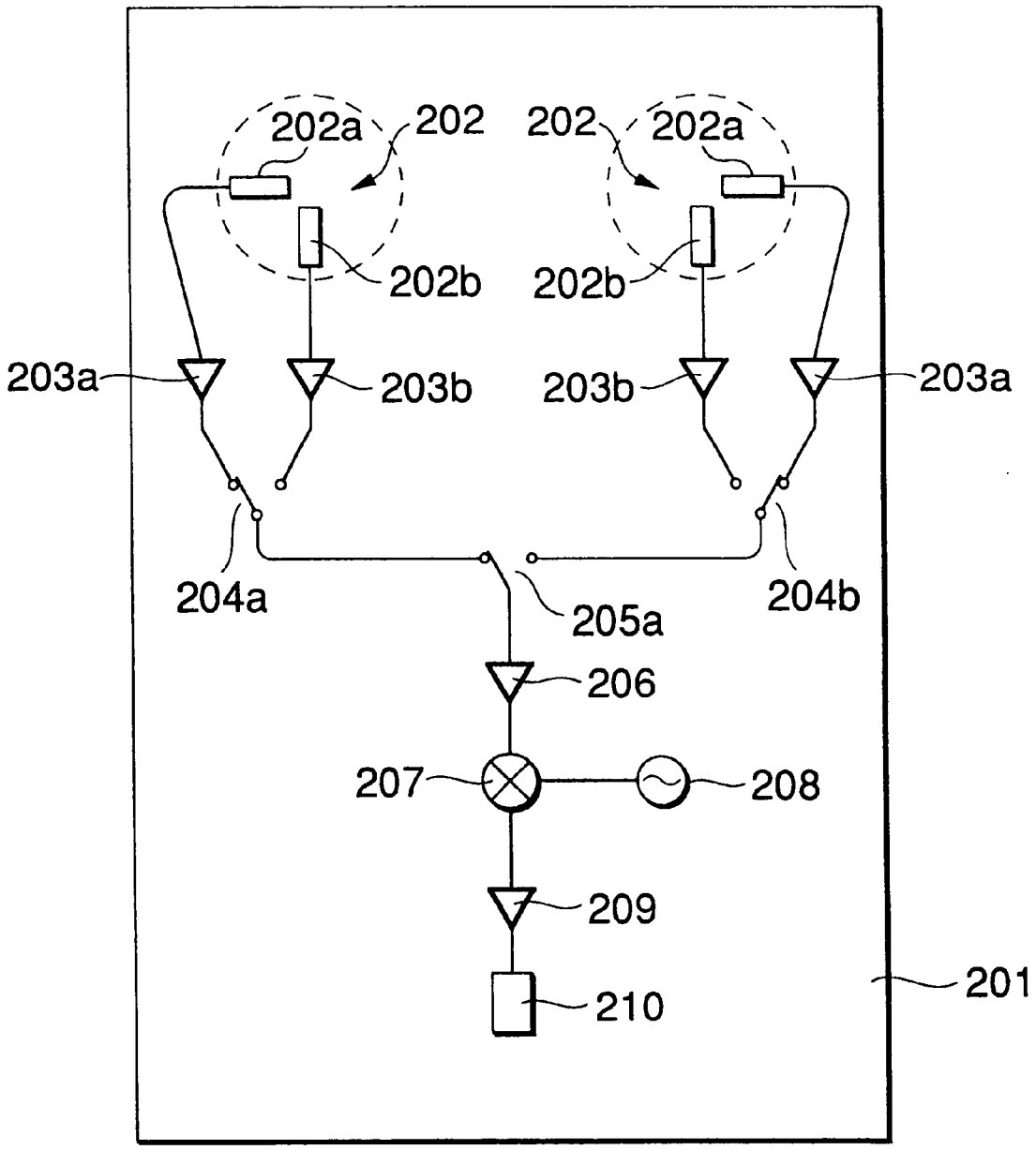
FIG. 29 is a view showing the circuit configuration of a conventional converter for receiving micro waves from satellites.

FIG. 28 is a view showing the configuration of a converter circuit portion in the tenth embodiment of the invention.

In the ninth embodiment described above, the substrate-printed probe substrates 231*a* and 231*b* corresponding to the circular waveguides 221*a* and 221*b* are rotatably disposed, and the substrate-printed probes 202 are disposed on the substrate-printed probe substrates 231*a* and 231*b*, respectively. In the tenth embodiment, a substrate-printed probe 202 which is used for receiving a micro wave from one satellite is disposed on the substrate 223, and one or more other probes for receiving a micro wave from a satellite are disposed on a substrate-printed probe substrate 231 which is formed separately from the substrate 223.

In the embodiment, the substrate-printed probe 202 which is fixedly disposed on the substrate 223 is adjusted by the angle adjustment mechanism 213 so as to receive a micro wave of the objective satellite, and the substrate-printed probe 202 which is disposed on the substrate-printed probe substrate 231 is adjusted by rotating the substrate-printed probe substrate 231 so as to receive a micro wave of the objective satellite.

Also in the second embodiment, in the same manner as the ninth embodiment, it is possible to use a common substrate even when micro waves from plural satellites are to be received, with the result that the productivity is improved and hence the production cost can be reduced.

As described above, the multibeam antenna of the invention comprises: a reflector which reflects and focuses micro waves from plural satellites; plural horn type primary radiators which receive the plural satellite micro waves which are reflected and focused by the reflector, respectively; a converter to which the plural horn type primary radiators are adjacently integrally attached, and which converts and amplifies satellite signals respectively received by the primary radiators; probes respectively for the primary radiators, the probes being arranged at an angle difference corresponding to a difference in polarization angle among the plural satellites under a state where the plural primary radiators are attached to the converter; a radiator supporting arm which supports the converter so that horns of the plural primary radiators are oriented to a direction of reflection of the reflector; and a rotation mechanism which is disposed between the radiator supporting arm and the converter, and which adjusts a rotation position of the converter so that an arrangement inclination angle of the primary radiators with respect to an axis which is in parallel with a ground, the arrangement inclination angle of the plural primary radiators, and a reception polarization angle of each of the radiators being simultaneously adjusted by the rotation mechanism. Therefore, the arrangement inclination angle of the primary radiators and the reception polarization angle can be easily adjusted.

In the multibeam antenna of the invention, the primary radiator is a circular waveguide aperture horn, and a dielectric part is attached to an aperture of the horn. Even in the case where satellites from which micro waves are to be received are separated from each other by a small elongation of 4 deg., therefore, a configuration for receiving multibeams can be constituted without causing the horns of the primary radiators to interfere or contact with each other.

In the multibeam antenna of the invention, the antenna further comprises receiving satellite switching means for, in accordance with external instructions, selecting one of the plural satellite signals received by the plural primary radiators, and outputting the selected signal. Therefore, a desired satellite broadcasting program can be easily selected so as to be received, without requiring an external switching device, wirings, and the like to be disposed.

Furthermore, according to the invention, two or more horns of a small flare angle or circular waveguides are integrated with each other, and one or more chokes having a depth of about one quarter of the wavelength are disposed around the integrated structure. Therefore, the edge portion of the aperture face has theoretically an infinite impedance, and hence a current which rearward flows from the edge portion of the aperture face can be suppressed, thereby preventing radiation toward the rear side of the primary radiator from occurring. Therefore, micro waves from plural satellites can be efficiently received.

As described above in detail, according to the invention, plural substrate-printed probe substrates are disposed independently from a substrate on which a converter circuit portion is formed, and configured so that the rotation angle of each of the substrate-printed probe substrates is arbitrarily adjusted. A substrate-printed probe which is used for receiving a micro wave from one of the satellites is disposed on the substrate on which the converter circuit portion is formed, and one or more other probes for receiving a micro wave from a satellite are disposed on a substrate-printed probe substrate which is formed separately from the above-mentioned substrate. Consequently, the converter can be easily made coincident with the polarization angles of plural satellites, and the inclination angle which is the angle difference between an axis which is in parallel with the ground and the axis of the satellite orbit. Even when the polarization angles of adjacent two satellites are changed or when a satellite from which a micro wave is to be received is changed to another one, therefore, the converter can be easily made coincident with the polarization angle. Furthermore, the use of a common circuit can reduce the production cost.

What is claimed is:

1. A primary radiator for a small-diameter multibeam antenna for receiving microwaves from geostationary satellites separated from each other by four degrees of elongation, comprising:

plural adjacent primary radiator apertures for receiving microwaves having wavelengths in the same band, each aperture provided with an outer peripheral wall; and at least two walls having the same height, which are disposed so as to commonly surround on said plural apertures, wherein the at least two walls define therebetween a choke having a depth of about one quarter of a center wavelength of said received microwaves in said band; and wherein a height of the outer peripheral wall of each aperture is equal to or less than the height of said at least two walls.

2. The primary radiator according to claim 1, further comprises dielectric members disposed in each of said primary radiator apertures for focusing said received microwaves therein.

3. The primary radiator according to claim 1, further comprises helical antennas disposed in each of said primary radiator apertures.

4. A converter for receiving microwaves from satellites, wherein the primary radiator according to claim 1 is integrated with a main unit of said converter.

5. A converter for receiving microwaves from satellites, wherein the primary radiator according to claim 2 is integrated with a main unit of said converter.

6. A converter for receiving microwaves from satellites, wherein the primary radiator according to claim 3 is integrated with a main unit of said converter.

7. The primary radiator as set forth in claim 1, wherein a height of an inner wall defining the inner-most choke is lower than a height of an outer wall thereof.

8. A primary radiator for a multibeam antenna for receiving microwaves from geostationary satellites, comprising:

a set of n primary radiator apertures for receiving microwaves having wavelengths in the same band, where n is 3 or more, said primary radiator apertures being arranged such that an angle between a line connecting centers of an arbitrary m-th aperture and (m+1)-th aperture and a line connecting centers of the m-th aperture and (m−1)-th aperture is determined in accordance with an elevation angle difference of the satellites associated with the m-th aperture and the (m+1)-th aperture, where m is 2 or more; and at least one wall disposed so as to commonly surround the apertures, the wall having a portion substantially parallel with the line connecting the m-th aperture and the (m+1)-th aperture, and a portion substantially parallel with the line connecting the m-th aperture (m−1)-th aperture, and defining at least one choke having a depth of about one quarter of a center wavelength of said received microwaves in said band.

9. The primary radiator according to claim 8, further comprises dielectric members disposed in each of said primary radiator apertures for focusing said received microwaves therein.

10. The primary radiator according to claim 8, further comprises helical antennas disposed in each of said primary radiator apertures.

11. A converter for receiving microwaves from satellites, wherein the primary radiator according to claim 8 is integrated with a main unit of said converter.

12. A converter for receiving microwaves from satellites, wherein the primary radiator according to claim 9 is integrated with a main unit of said converter.

13. A converter for receiving microwaves from satellites, wherein the primary radiator according to claim 10 is integrated with a main unit of said converter.

14. The primary radiator as set forth in claim 8, wherein a height of an inner wall defining the inner-most choke is lower than a height of an outer wall thereof.

* * * * *